US005259652A

United States Patent [19]

Adams et al.

[11] Patent Number: 5,259,652

[45] Date of Patent: Nov. 9, 1993

[54] DOOR LATCH ASSEMBLY

[75] Inventors: Richard Adams, Fleetwoood; Philip C. Ellis, Reading; Jay L. Snavely, Shillington, all of Pa.

[73] Assignee: Baldwin Hardware Corporation, Reading, Pa.

[21] Appl. No.: 636,356

[22] Filed: Dec. 31, 1990

[51] Int. Cl.[5] ..... E05C 1/16

[52] U.S. Cl. ..... 292/169.14; 292/169.16; 292/169.18; 292/169.21

[58] Field of Search ..... 292/169.14, 169.16, 292/169.18, 169.21, 358

[56] References Cited

U.S. PATENT DOCUMENTS

| | | | |
|---|---|---|---|
| 2,473,080 | 6/1949 | Vander Henst | 292/169.16 |
| 2,593,573 | 4/1952 | Kulbersh | 292/169.16 |
| 2,743,600 | 5/1956 | Heyer | 292/169.16 |
| 2,755,121 | 7/1956 | Aslagsen | 292/169.16 |
| 2,808,279 | 10/1957 | Schlage | 292/169.14 |
| 4,108,482 | 8/1978 | Dietrich et al. | 292/169.16 |
| 4,974,883 | 12/1990 | Jans | 292/169.14 |

FOREIGN PATENT DOCUMENTS 3070067 6/1970 Australia .

*Primary Examiner*—Eric K. Nicholson

*Attorney, Agent, or Firm*—Myron B. Kapustij; Malcolm L. Sutherland

[57] ABSTRACT

A latch assembly comprising a housing; a latch element retractably mounted in said housing; a spindle extending transversely through the housing and rotatably mounted therein; an operative connection between the spindle and the latch element whereby the latch element is retracted into the housing in response to turning movement of the spindle comprising two hub elements relatively rotatably mounted on the spindle, an operating plate arranged to move longitudinally of the housing in response to rotational movement of the hub elements, a drawbar attached to the latch element for movement therewith, and a latch lever through which movement of the operating plate is translated to the drawbar; and a pawl for selective engagement with one or the other or neither of said hub elements.

7 Claims, 4 Drawing Sheets

DOOR LATCH ASSEMBLY

FIELD OF THE INVENTION

This invention relates to a latch assembly for doors. More particularly it relates to a latch assembly incorporating a privacy feature therein.

SUMMARY OF THE INVENTION

The instant invention is directed to a tubular latch assembly incorporating a privacy feature comprising a housing; a latch element retractably mounted in said housing; and actuating means for retracting said latch element comprising a spindle extending transversely through said housing and rotatably mounted therein, a pair of hub elements relatively rotatably mounted in side-by-side relationship on said spindle, and an operative connection between said hub elements and the latch element whereby the latch element is retracted in response to rotational movement of the spindle, and therefore the hub elements, from a rest position. The latch assembly of the instant invention further includes latching means which is at rest in one of three positions allowing selective latching of either hub element or latching of neither hub element, and which further has a means of selectively restricting the latching means to two of the three positions, latching of one of the hub elements and neutral unlatched position, and further has a feature which moves the latching feature to the unlatched position when the latch element is moved to the unlatched position.

Tubular latches are a class of latches that fit into a bored hole in the edge of a door and are operated by rotating knobs or levers that are mounted on the face of the door. In the most common type of tubular latch, the translation from rotational to linear movement is accomplished by a cam and drawbar arrangement. Because of practical considerations governing the diameter of the housing and the distance through which the latch must move, latches of this type usually require 70 to 80 degrees of rotational movement of the knob or lever to move the bolt from the latched to the unlatched position. For ergonomic reasons it is desirable to limit rotation to less than 45 degrees when levers are used, and this can be accomplished in a number of ways—increasing the diameter of the rotational elements, restricting the latch or bolt travel, or the use of levers or ramps. In addition, it is desirable in lever latches to provide a heavier spring to support the levers in a level position and prevent them from partially opening the latch by their weight. Furthermore, it is desirable to have the additional spring pressure applied to the cam or rotational elements only, as additional pressure applied through the drawbar wears the mechanism quickly thereby resulting in a short lived latch. The additional spring pressure may be applied by placing springs in the external trim, but this limits the aesthetic design of the trim and adds to the part count and complication of the product. Another answer is to place the additional springs in the latch housing. Practical limits on the diameter of the case restrict tubular latches with such internal auxiliary springs to one direction of rotation.

There are two main consequences of this restriction. First, since the latch can no longer be rotated 180 degrees around its long axis (i.e. turned upside down) to accommodate both left and right opening doors, it is common practice to provide a means of rotating the bolt. Secondly, if the latch is to be fitted with an internal privacy mechanism, the privacy mechanism must now be operable from either side of the latch.

Privacy mechanisms are settable means of rendering a latch inoperable from outside (inside and outside referring to the room into which the door opens) knob or lever, while at the same time providing a means of unsetting the mechanism from outside should an emergency require it. This is done in a wide variety of ways, one of which is to split the hub vertically into an inside hub and outside hub which rotate on a common axis but are capable of rotating independent of each other. A pawl is movable along an axis normal to the face of the door and engages a slot in the outside hub, preventing that hub from rotating. The inside hub is not capable of engaging the pawl. Latches employing this type of privacy generally contain an egress feature as well, which uses the longitudinal movement of the bolt to unset the privacy mechanism when the inside knob or lever is turned or when the door is closed.

Latches having privacy mechanisms of the type described above are usually inverted to accommodate in or out closing doors. This presents a problem when the latch is of a type which rotates in only one direction. It is readily seen that, while this latch would be operable in the normal manner from one side, pushing a button or rod on the trim to activate the privacy mechanism, that it would be necessary to pull the activating pawl on the other side, causing confusion if it were used on doors of various hands in the same building. Furthermore, in the one case the privacy feature could be unset in the normal way, pushing with a tool through the outside trim, but in the other, a tool would have to be fitted to pull the privacy mechanism into the unset position, a considerable complication.

The present invention solves these problems in the following way. The two hub elements, which may be independently rotatable, are relieved along the center plane of the latch to provide a neutral position between the two hub elements where the pawl can reside without engaging either hub element. Both hub elements are equipped with slots for engaging the pawl. The pawl is provided with detents, for example, a spring and three annular grooves, which allow it to rest in three stable positions, neutral, not engaged with either hub element, engaged with the outside hub element, or engaged with the inside hub element. In addition, in one embodiment of the present invention a removable bushing may be installed on the "outside" end of the pawl before or during installation, which restricts the pawl to two positions, neutral and engaged with the "outside" hub. The bushing is installed on whichever end of the pawl is outside and sets the hand of the latch, rendering it reversible without any of the unfortunate effects previously mentioned. In addition, the pawl has a "V" shaped groove which engages the drawbar in such a way as to move the pawl to the neutral position whenever the bolt is moved to the unlatched position, either by turning the inside knob or by closing the door.

DETAILED DESCRIPTION OF THE PREFERRED EMBODIMENT

Figure 10:
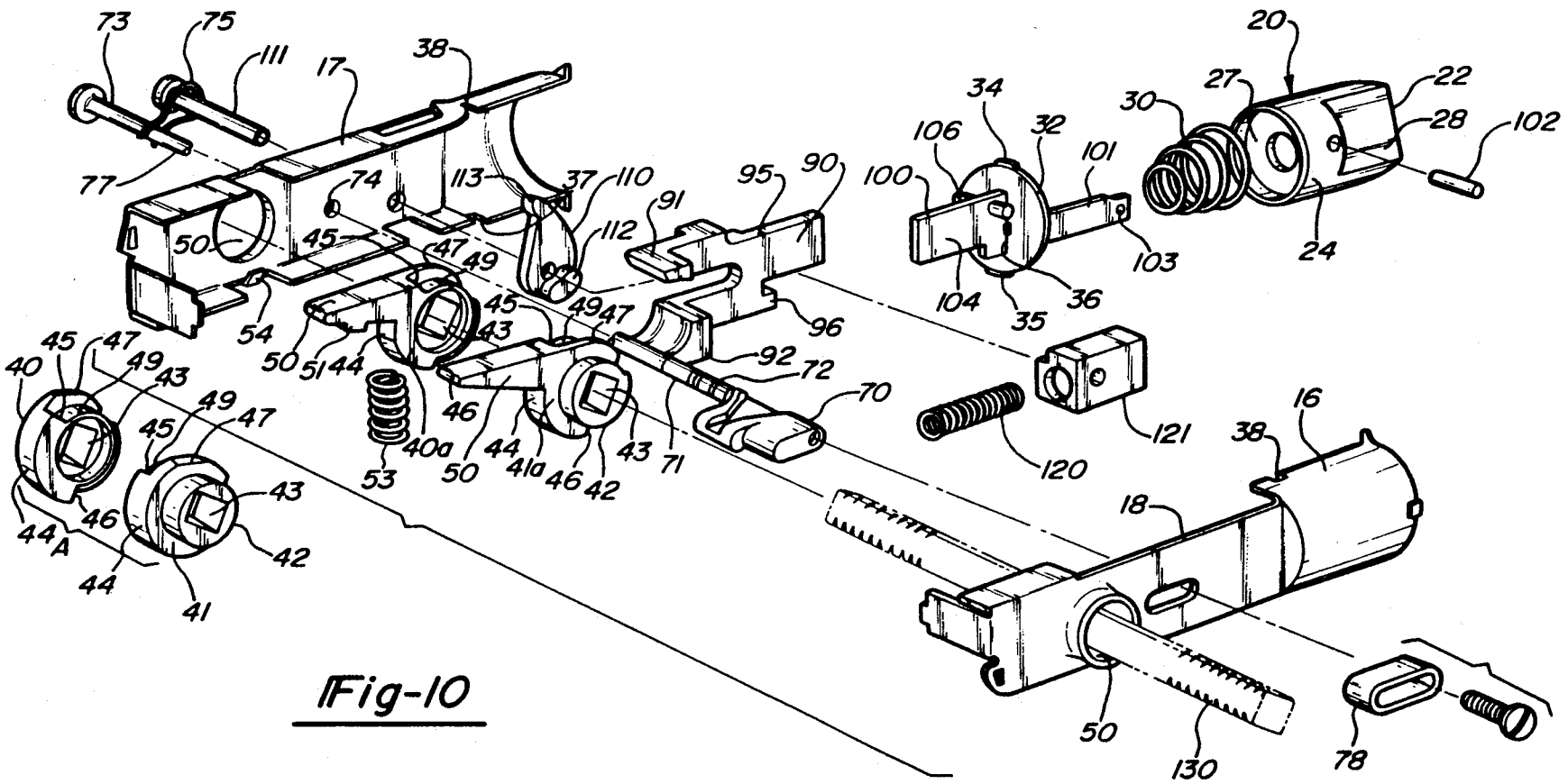
FIG. 10 is an exploded perspective view of the latch assembly.

Referring now to the drawings, a latch assembly constructed in accordance with the teachings of the present invention is illustrated and includes an elongated housing 10 defining an interior 12. An opening 14 is disposed at the front section of the housing and communicates with the housing interior. As best illustrated in FIG. 10 the front section 16 of the housing 10 is generally of circular cross-sectional shape.

The housing 10 is comprised of two housing segments 17, 18 secured together by securing or fastening means.

A latch element 20 is longitudinally slidably disposed within the housing interior 12. The latch 20 includes a nose portion 22 and a body portion 24. The nose portion 22 of latch 20 is provided with the usual sloping surface 26 for engaging a cooperative striker plate on a door jamb, and a substantially flat or straight latching surface 28.

The body portion 24 of the latch may be of substantially circular cross-sectional shape so as to slidingly fit within the front section 16 of housing 10. The latch 20 is normally biased so that nose portion 22 thereof normally extends through opening 14 beyond the front end of the housing 10.

The latch may be biased by means of a coil compression spring 30 having one end thereof disposed in a recess 27 formed in latch body 24. The other end of spring 30 engages wall member 32. Wall member 32 is generally circular in shape so as to fit within front section 16 of the housing 10. Wall member 32 is secured against longitudinal movement in the interior 12 of housing 10 by tabs 34, 35 on its periphery inserted into corresponding slots 37, 38 in the housing 10. Spring 30 continuously urges latch 20 in a direction toward opening 14 so that nose portion 22 normally extends through opening 14 beyond the front of the housing. The latch is longitudinally reciprocatatively movable in the interior 12 of the housing between an extended position where the nose portion 22 projects beyond the housing interior through opening 14, as illustrated for example in FIGS. 4 and 6, and a retracted position where the nose portion is substantially completely retracted in the housing interior, as illustrated for example in FIGS. 5 and 7.

Means are operatively associated with latch 20 for moving the latch from the extended position to the retracted position. The latch moving means includes hub means rotatably mounted in the housing 10 and adapted to be rotated by actuator means accessible outside the housing. In particular, the hub means includes two independently rotatable hub elements 40, 41 in the embodiment illustrated in FIGS. 1, 2, 3, 6, 7, 8 and 9, and **40*a*, 41*a* in the embodiment illustrated in FIGS. 4 and 5, disposed side-by-side in the interior 12 of housing 10. Each of the hub elements 40, 41 or 40*a*, 41*a* includes a round boss 42 which projects through a corresponding hole 50 formed in each of the housing segments 17, 18 whereby the hub elements 40, 41 or 40*a*, 41*a* are maintained in position and are yet rotatable to a degree within the housing. A lobe 44 is formed on the rear surface of each hub element 40, 41 or 40*a*, 41*a* defining two forwardly facing shoulders 45, 46 projecting radially beyond the outer surface of each of the hub elements 40, 41 or 40*a*, 41*a*. In the rest position of the hub elements, as best illustrated in FIGS. 1, 2, 4 and 8, the two shoulders 45, 46 of each hub element extend upwardly and downwardly, respectively. Extending forwardly of shoulders 45, 46 on the front surface of each hub element 40, 41 or 40*a*, 41*a* adjacent boss 42 is a narrow radially protruding circumferentially extending flange 47. Flange 47 has a notch 48 in its front. The notch 48** is preferably concave or semi-circular in shape.

Flange 47 is narrower than lobe 44 thereby defining, with shoulders 45, 46 of lobe 44 a relieved portion 49 in the hub axially inwardly of flange 47. The relieved portions 49 of the two hubs are adjacent each other when the hubs are mounted side-by-side in the housing and provide, as described below, a neutral position between the flange 47 of each hub where the pawl 70 can reside without engaging either flange of the two hubs.

The latch moving means also includes an operating member 90 arranged to move longitudinally in the interior 12 of housing 10 in response to rotation of hubs 40, 41; a drawbar 100 attached to the latch for longitudinal movement therewith, and a latch lever 110 through which movement of the operating member is transmitted to the drawbar 100. The latch lever 110 magnifies movement of the operating member 90, thereby providing relatively large latch movement in response to relatively small movement of the operating member.

Figure 1:
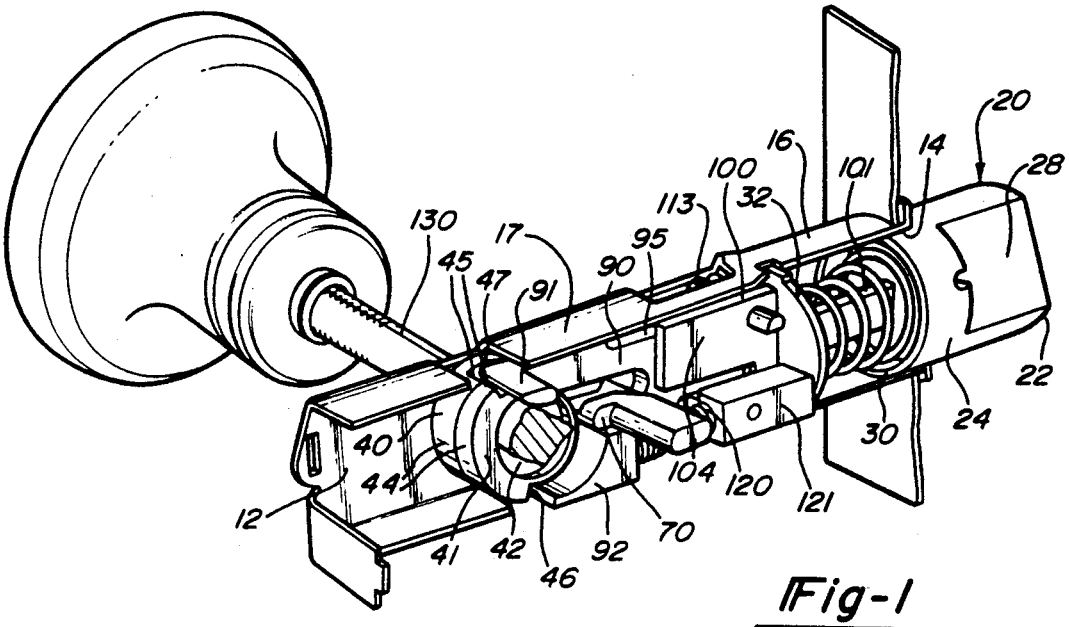
FIG. 1 is a fragmentary perspective view of a latch assembly constructed in accordance with the teachings of the instant invention.
Figure 4:
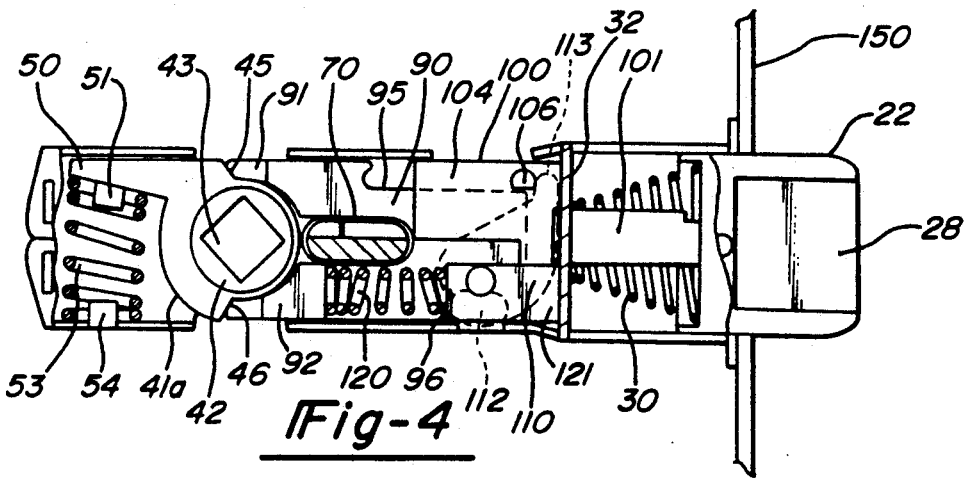
FIG. 4 is a side elevational view of another embodiment of the latch assembly of the instant invention showing the latch in an extended position.

In the embodiment illustrated in the drawings the operating member 90 comprises an operating plate disposed in the housing with its planar surfaces being vertical. The plate is bifurcated at its rear end to provide a first abutment section 91 and a second abutment section 92 which are respectively engageable with shoulders 45 and 46 of the lobes 44 of hubs 40, 41 or **40*a*, 41*a* as best shown in FIGS. 1 and 4. The abutment sections 91, 92 are generally horizontally extending and are sized to fit within the relieved portion 49 of both hubs. A first front surface section 95 of operating plate 90 forms a guide section while a second front surface disposed on the opposite edge of operating plate 90 forms a striker surface 96**.

The latch lever 110 is pivotally mounted in the housing on a pivot pin 111 which extends between support recesses formed in the housing. The axis of the pivot pin is parallel to the axis of spindle 130.

The latch lever 110 may be in the form of a plate located to one side of operating plate 90 and in substantially face to face relationship therewith. A lug 112 or similar projection extends laterally from one edge of latch lever 110 for engagement with the striker surface 96 of operating plate 90. An arm 113 extends from the other edge of lever 110 for engagement with drawbar 100 as described hereinafter.

The drawbar 100 may be comprised of a generally flat plate comprising an elongated front body portion 101 attached to latch body 24 at a front end portion thereof by attachment pin 102 inserted through attachment hole 103, and a rear body portion 104 engageable with latch lever 110. Engagement with latch lever 110 may be effected in any appropriate manner. However, in a preferred embodiment the drawbar 100 is located on the side of operating plate 90 opposite the side which is adjacent to and in face-to-face relationship with latch lever 110. The rear body portion 104 of drawbar 100 is in face-to-face relationship with operating plate 90, and is disposed to the rear of wall member 32, with the elongated front body portion 101 passing through an aperture 36 in said wall member 32 and being disposed to the front of said wall member. In this embodiment the operating plate 90, more specifically the guide section 95 thereof, is in effect sandwiched between adjacent portions of the drawbar 100, more specifically the rear body portion 104 of the drawbar, and the latch lever 110.

A lug, pin or other projection 106 extends laterally from the rear body portion 104 of the drawbar 100 in the direction of the operating plate 90 and over the guide portion 95 thereof. This projection 104 locates behind and is engageable by arm 113 of the latch lever 110.

Spindle 130 projects completely through the housing 10, passing through bores 43 formed in the hub elements at the location of the bosses 42. It will be appreciated that spindle 130 has attached to each end thereof a manually manipulable element such as levers, handles, or door knobs. If the spindle 130 is of the type which may be rotated in its entirety by either of the manually manipulable elements, either will rotate both hubs. Thus, the disclosed latch device functions as a passage latch permitting the latch device to be operated from both sides of the door.

On the other hand, and preferably, spindle 130 may be comprised of two relatively rotatable spindle components connected together by a connector which allows the spindle components to be individually rotated by their respective associated knobs or levers. A spindle of this type, which is split into two parts capable of independent movement, is known in the art and will, therefore, not be described in detail herein.

The spindle may be of square or other non-circular cross-sectional shape and extends through a substantially complementary shaped axial bore 43 of the hub elements so that rotation of the spindle causes corresponding rotational movement of the hub element(s).

In operation of the latch assembly of the instant invention rotation of either or both of the hubs 40, 41 or **40*a*, 41*a* by the spindle 130 will result in the shoulder 45 or 46 of the hub element(s) engaging, depending upon whether rotation is clockwise or counterclockwise, the abutment section 91 or 92 of operating plate 90 thereby moving operating plate 90 in a forward direction. Forward movement of operating plate 90 causes the striker surface 96 of the operating plate 90 to engage lug 112 of latch lever 110. This causes pivoting of the latch lever 110 in a counterclockwise direction with consequent rearward rotational movement of arm 113 of latch lever 110. In its rearward rotational travel arm 113 engages lug 106 of drawbar 100, thereby pulling the drawbar 100 and the latch 20** to which it is attached to the rear, i.e., retracting the latch.

Figure 5:
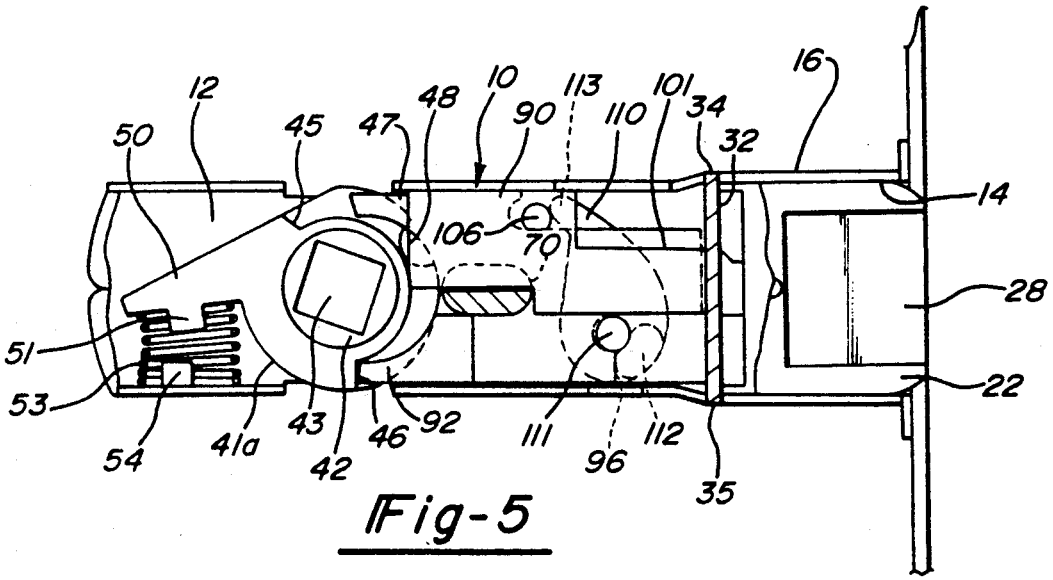
FIG. 5 is a view similar to that of FIG. 4 but showing the latch in a retracted position.

FIG. 4 illustrates the latch in its extended position with the arm 113 of latch lever 110 in its forward position. FIG. 4 also illustrates the drawbar 100 in its forward position and the operating plate 90 in its rearward position. The shoulders 45, 46 of hub **41*a* in FIG. 4 are illustrated in their rest position. FIG. 5 illustrates the latch in its retracted position with the arm 113 of the latch lever 110 being pivoted rearwardly and engaging lug 106 of drawbar 100, thereby pulling drawbar 100 to the rear. FIG. 5 also illustrates the shoulder 46 in its forward position impinging upon abutment surface 92 of operating plate 90, in which position operating plate 90 is forced forward with its striker surface 96 engaging lug 112 of latch lever 110 thereby pivoting latch lever 110 in a counterclockwise direction with consequent rearward movement of arm 113**.

In the embodiment illustrated in FIGS. 1, 2, 3, 6, 7, 8, 9, and insert A in FIG. 10, the lobes 44 of hub elements 40, 41 have generally rounded outer surfaces, i.e., are generally semi-circular in contour. In view of this, and due also to the presence of two shoulders 45, 46 on each hub element along with the two abutment surfaces 91, 92 of operating plate 90, rotation of the spindle, and therefore the associated hub, in either direction, i.e., clockwise or counterclockwise, will actuate the latch moving means and cause retraction of the latch 20 into the interior 12 of housing 10.

In the embodiment illustrated in FIGS. 4 and 5, and main FIG. 10, hubs **40*a* and 41*a* have a horizontal tail portion 50 extending rearwardly from the lobes 44. The tail portion 50 has a spring guide 51 projecting therefrom. Spring guide 51 corresponds to spring guide 54 in the housing 10. A compression coil spring 51 is disposed between spring guides 51 and 54 and biases the tail portion 50, and therefore element hub 41*a*, in an upward direction (i.e., to an extended position of the latch as shown in FIG. 4). Rotation of the spindle 130 only in a counterclockwise direction in FIGS. 4 and 5 retracts the latch, as shown in FIG. 5, and causes compression of the spring 53. Upon release of the spindle the spring forces the hub 41*a* to its rest position in which the latch is in its extended position as shown in FIG. 4**.

In the embodiment where spindle 130 incorporates two relatively rotatable spindle components as described supra, the latch device can be readily adjusted to permit latch retraction by either of the hubs to the exclusion of the other. In other words, the latch device has a built-in privacy locking feature. This feature is described below.

Figure 2:
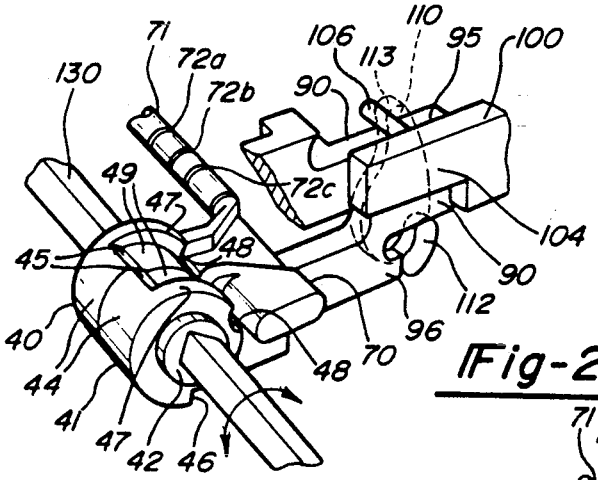
FIG. 2 is a fragmentary perspective view showing a portion of the latch assembly and further showing one hub element (the left) locked against rotation and with both hub elements in the rest position (latch extended)
Figure 3:
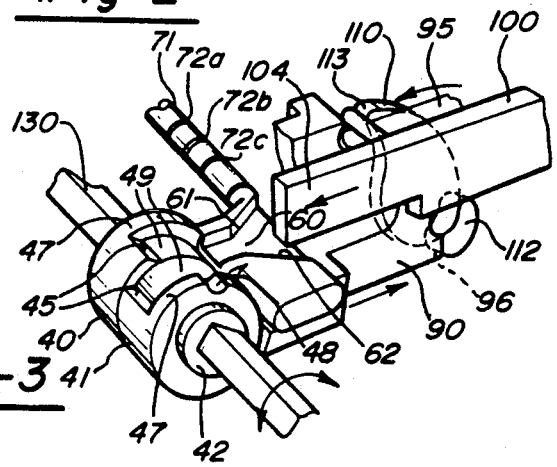
FIG. 3 is a view similar to that of FIG. 2 but showing one hub element (the left) locked against rotation while the other hub element (the right) is rotated so as to retract the latch.
Figure 8:
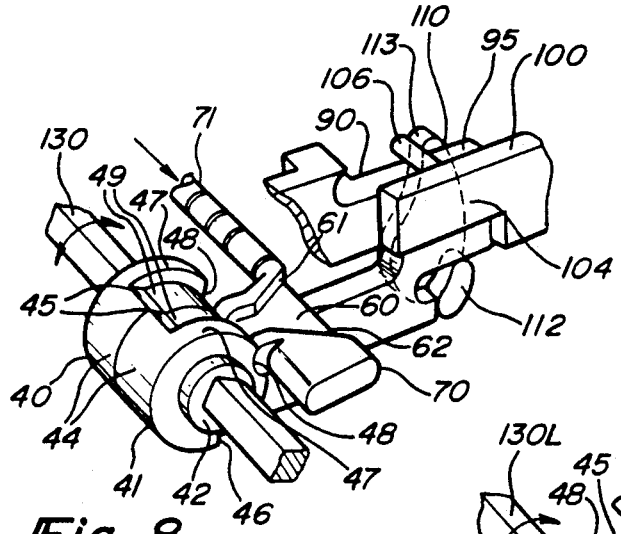
FIG. 8 is a view similar to FIG. 2 but showing the other hub element (the right) locked against rotation.
Figure 9:
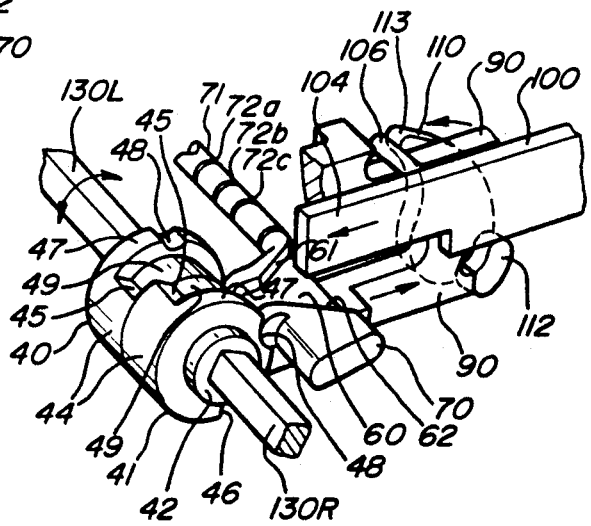
FIG. 9 is a view similar to FIG. 3 but showing the other hub element (the right) locked against rotation while the left hub element is rotated so as to retract the latch.

Disposed immediately adjacent to hub elements 40, 41 or **40*a*, 41*a* is a privacy locking means. Privacy locking means is comprised of pawl 70 which is movable normal to the plane of rotation of hub elements 40, 41 or 40*a*, 41*a*, drawbar 100, and operating plate 90. The pawl 70 can be set in three positions. In the first position, as illustrated in FIGS. 2 and 3, pawl 70 engages the notch 48 of the first hub element thereby preventing said first hub element from rotating but leaving the second hub element free to rotate. In the second position, as illustrated in FIGS. 8 and 9, the pawl 70 engages the notch 48 of the second hub element thereby locking said second hub element against rotation but leaving said first hub element free to rotate. In the third position, the neutral position, the pawl 70 does not engage either notch 48 of either of the hub elements but rests between the two flanges 47 of the two hub elements in the relieved portion 49 defined by the flanges 47 and the shoulders 45 and 46. In this position both hub elements are free to rotate. The pawl 70 has a control spindle 71 projecting from one side thereof. It will be appreciated that lateral movement of control spindle 71 causes a corresponding lateral movement of the pawl 70** to one of the three aforedescribed positions.

Figure 6:
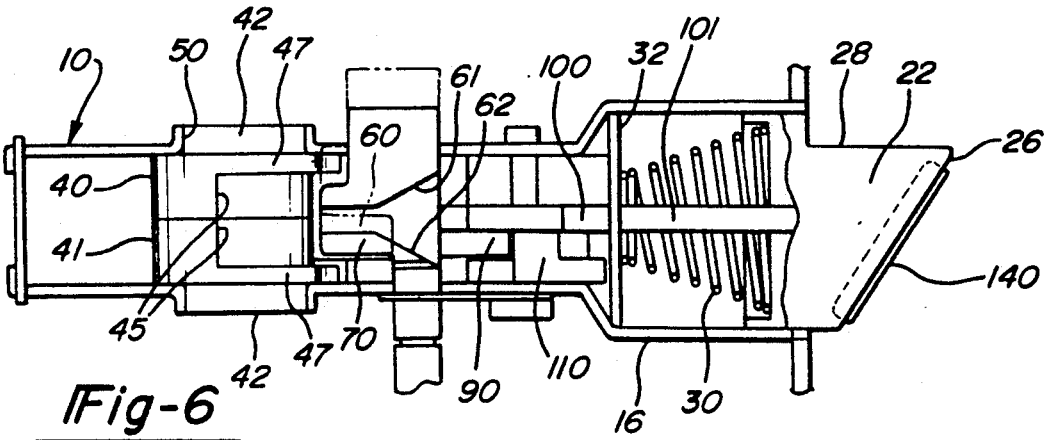
FIG. 6 is a top elevational view of the latch assembly showing the latch in an extended position.
Figure 7:
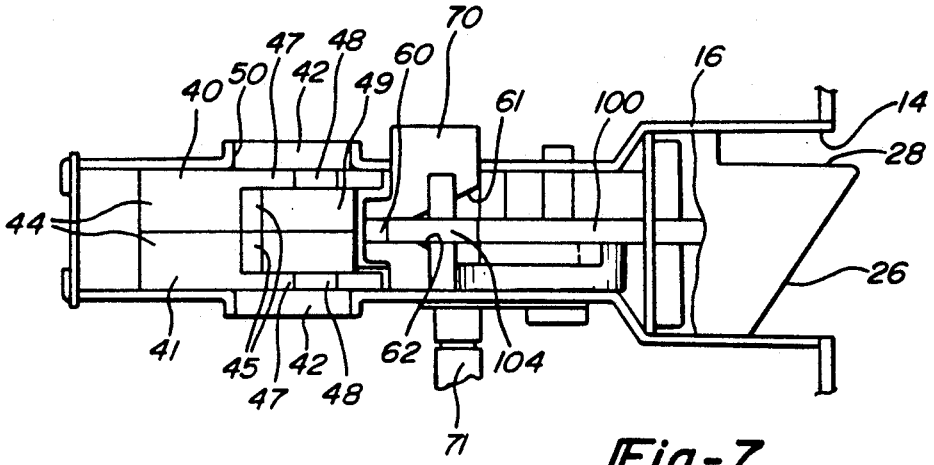
FIG. 7 is a view similar to that of FIG. 6 but showing the latch in a retracted position.

It should be noted that a series of grooves 72 are formed in the control spindle 71. In the structure illustrated in the drawings there are three grooves 72*a*, 72*b* and 72*c*. As may best be seen in FIG. 10 control spindle 71 extends through aperture 74 formed in housing segment 17. A detent element in the form of a resilient clamp 75 is secured to housing segment 17 adjacent to aperture 74 through which control spindle 71 projects. The resilient clamp 75 engages grooves 72*a*, 72*b* and 72*c* in control spindle 71. When clamp 75 is in engagement with groove 72*a* the pawl 70 is in the second position as described herein and as illustrated in FIGS. 8 and 9. When clamp 75 is in engagement with groove 72*b* the pawl 70 is in the neutral position, i.e., the third position as described herein and as illustrated in FIGS. 6 and 7. When clamp 75 is in engagement with groove 72*c* the pawl 70 is in the first position as described herein and as illustrated in FIGS. 2 and 3.

In the structure illustrated in FIG. 10 operating rod 73 is threadedly connected to control spindle 71 by means of external threads 77 mating with the internally threaded opening in the end of control spindle 71.

In yet another embodiment of the instant invention a removable bushing 78 is provided which restricts lateral movement of control spindle 71 and, therefore, pawl 70, to only two of the aforedescribed positions. With the bushing 78 installed pawl 70 can either rest in the neutral position or engage the notch 48 of the hub element on the side in which the bushing is installed. Installing the bushing 78 on the opposite side of the housing 10 effectively reverses the hand of the latch assembly. In this embodiment the privacy feature is operable on only one side of the door.

In still yet another embodiment, generally used in conjunction with the embodiment described above including the bushing 78, pawl 70 has a generally Y-shaped groove 60 defined by two side edges 61 and 62. Edges 61 and 62 diverge at an angle to each other to form a "V". Upon rearward movement of the drawbar 100, the rear body portion 104 thereof engages either edge 61 or 62 of pawl 70 (depending upon which hub element is engaged by the pawl), and forces pawl 70 to move laterally to the neutral position. With this feature one cannot accidentally lock oneself out of a room by forgetting to disengage the privacy feature. For example, taking the situation illustrated in FIG. 9, it is noted that the right hub element is engaged by pawl 70, thereby locking it against rotation. The latch element can only be actuated by the left spindle 130L. However, actuating the latch element by spindle 130L causes the rear body portion 104 of drawbar 100 to move rearward and engage side edge 61 of pawl 70, thus moving pawl 70 laterally to the neutral position and, in effect, unlocking the right hub element or deactivating the privacy feature.

Particularly in the embodiments of the instant invention illustrated in FIGS. 1, 2, 3, 6, 7, 8 and 9 means for biasing hub elements 40, 41 to their rest position, as illustrated in FIG. 1, is provided. In the structure illustrated in the drawing the biasing means include a coil spring 120 impinging at one end thereof upon abutment surface 92 of operating plate 90 and at the other end thereof against a block member 121 fixedly attached to the housing. The spring 120 forces abutment surface 92 against shoulders 46 of hub elements 40, 41 thereby rotating the hub elements to their rest position.

In yet a further embodiment as illustrated in FIG. 6, a strip of low friction plastic material 140 is inserted into the recess formed in sloping surface 26 to lessen the force required to close the door.

Furthermore, the latch element 20 is rotatable relative to the housing 10, and is secured against further rotation by face plate 150 which has an aperture through which the nose portion 22 of latch element 20 extends. The aperture in the face plate 150 has a configuration generally corresponding to the cross-sectional configuration of the nose portion 22 of latch element 20. In other words, the aperture includes a straight segment which corresponds to the latching surface 28 of the latch nose portion 22.

The straight latching surface 28 of the nose portion 22 must be in a position corresponding to the location of the straight aperture segment or the nose portion 22 of latch element 20 will not pass through the aperture. By rotating the face plate 150 one hundred eighty degrees the straight aperture segment will be disposed on either the left or the right as required by the particular door with which the latch assembly is employed.

Other modifications can be made to those which have been described in the text and illustrated in the figures by way of example without departing from the scope of the instant invention.

What is claimed is:

1. A latch assembly comprising:

a housing defining an interior and an opening at one end of said housing communicating with said interior;

a latch element disposed in said housing interior comprising a nose portion and a body portion, said latch element being linearly reciprocatably movable relative to said housing between an extended position wherein said nose portion projects from said housing interior through said opening and a retracted position wherein said nose portion is retracted in said housing interior;

means operatively associated with said latch element for moving said latch element from said extended position to said retracted position comprising hub means comprising two hub elements having a notch therein independently rotatably mounted relative to said housing and adapted to be rotated by actuator means accessible outside said housing, operating means operatively associated with said hub means mounted within said housing for movement in a linear direction in response to rotation of said hub means, a drawbar attached to said latch element and operatively associated with said operating means through a latch lever pivotally mounted in said housing to cause retraction of the latch element during linear movement of said operating means toward said latch element; and means for selective engagement of either or none of said hub elements to selectively secure one of said hub elements against rotation comprising a pawl laterally movable in said housing and engageable with one of said notches in one of said hub elements to prevent rotation of said engaged hub element, said latch element being movable from said extended position to said retracted position only upon rotation of a hub element which is not in engagement with said means for selective engagement.

2. The latch assembly according to claim 1 wherein said latch lever has a laterally extending projection adapted to be engaged by said operating means and an arm adapted to engage said drawbar, said latch lever pivoting in response to said operating means engaging said laterally extending projection whereby said arm engages said drawbar causing linear rearward movement of said drawbar in said housing and retraction of said latch element.

3. The latch assembly according to claim 2 wherein said hub elements have a radially protruding flange extending peripherally thereof, said flange having a notch therein adapted to be engaged by said pawl.

4. The latch assembly according to claim 3 wherein the pawl has a Y-shaped slot in the surface thereof adapted to be engaged by the drawbar in its rearward movement whereby said pawl is moved laterally to a position intermediate the flanges of said hub elements wherein it is in engagement with neither of said slots in said flanges.

5. A door latch comprising a housing; a latch reciprocatably mounted in said housing: means for operating said latch including two hub elements each having a single notch therein independently rotatably mounted in the housing; means to selectively engage either or none of said hub elements against rotation comprising a pawl slidably mounted in said housing engageable with one of said notches in one of said hub elements to prevent rotation of said engaged hub element; means for moving said pawl in either direction from its neutral position where it is not engaged with either of said hub elements to engage either of said hub elements as desired; and means to move said pawl to its neutral position from either of its engaged positions when the latch is retracted.

6. A door latch according to claim 5 wherein each of said hub elements includes a radially extending flange adjacent the outer side thereof, said flange having a notch in the radially outer surface thereof adapted to be engaged by said pawl, said flanges defining a recessed area therebetween adapted to accommodate said pawl therein in the neutral position of said pawl.

7. The door latch according to claim 5 wherein said means for moving said pawl to its neutral position from its engaged position when the latch is retracted comprises a Y-shaped slot in the surface of said pawl adapted to be engaged by a drawbar during retraction of the latch whereby said pawl is moved laterally to a neutral position intermediate said flanges of said hub elements where it is in engagement with neither of said slots in said flanges.

* * * * *